US009022904B1

(12) United States Patent
Dorsey, III

(10) Patent No.: US 9,022,904 B1
(45) Date of Patent: May 5, 2015

(54) MARTIAL ARTS TRAINING SHIELD

(76) Inventor: Julius L. Dorsey, III, Rochester, NY (US)

( * ) Notice: Subject to any disclaimer, the term of this patent is extended or adjusted under 35 U.S.C. 154(b) by 117 days.

(21) Appl. No.: 13/317,822

(22) Filed: Oct. 31, 2011

(51) Int. Cl.
*A63B 69/26* (2006.01)
*A63B 69/34* (2006.01)
*A63B 69/00* (2006.01)

(52) U.S. Cl.
CPC ..... *A63B 69/004* (2013.01); *A63B 69/0086* (2013.01)

(58) Field of Classification Search
USPC ..... 482/77, 92, 93, 105, 83–90; 427/258; 474/258; 473/442, 443, 441, 445, 518; D21/798; 2/455, 456, 463, 464
See application file for complete search history.

(56) References Cited

U.S. PATENT DOCUMENTS 1,044,987 A * 11/1912 Campbell ..... 482/88
3,427,021 A * 2/1969 Donato ..... 482/83
3,759,515 A * 9/1973 Crooks ..... 273/440
4,667,954 A * 5/1987 McCorkle ..... 482/86
4,946,159 A * 8/1990 Jones ..... 482/83
5,501,649 A * 3/1996 Queppet ..... 482/88
6,325,747 B1 * 12/2001 Norblom ..... 482/83
8,287,437 B1 * 10/2012 Rovere ..... 482/83
2009/0082179 A1 * 3/2009 Le ..... 482/88

* cited by examiner

*Primary Examiner* — Loan H Thanh
*Assistant Examiner* — Nyca T Nguyen
(74) *Attorney, Agent, or Firm* — Tracy Jong Law Firm; Tracy P. Jong; Cheng Ning Jong

(57) ABSTRACT

A martial arts training shield for wear by a shield Holder as a target for impact by a Fighter, includes hemispherical front striking member mounted on a rear interspacer, all adapted for wear on a shield Holder by suitable strap works. The front striking member is a pad of high density foam material. The interspacer is a body of lightweight foam material in a supporting framework to establish a distance between Fighter and Holder. Control handles on the interspacer permit Holder to control position and attitude of the shield. With the shield in place, Fighter can perform a multitude of techniques as the Holder is dodging and averting the Fighter.

2 Claims, 4 Drawing Sheets

MARTIAL ARTS TRAINING SHIELD

BACKGROUND INFORMATION

This invention relates to martial arts and boxing, and more specifically to a training shield for wear by a Holder as the target for various attacks by a Fighter.

SUMMARY OF THE INVENTION

In summary, this invention is a martial arts training shield for wear by a shield Holder as a target for impact by a Fighter. The shield includes hemispherical front striking member mounted on a rear interspacer, all adapted for wear on a shield Holder by suitable strap works. The front striking member is a pad of high density foam material enclosed in a protective cover. The interspacer is a body of lightweight low density foam material within a supporting framework to establish a distance between Fighter and Holder. Left and right control handles on the interspacer permit the Holder to control position and attitude of the shield relative to his own torso and relative to the Fighter.

With the shield in place on a Holder, a Fighter can perform all of the following techniques without pause as the Holder dodges and averts the Fighter: kicks, punches, hand strikes, knee action. At the same time the Holder, with shield in place and hands on the handles, can: stand still; move backward and forward; move side to side; circle the Fighter; charge the Fighter; avoid or dodge the Fighter; and brace for impact by taking a forward leaning stance.

DRAWING

DESCRIPTION

Figure 1:
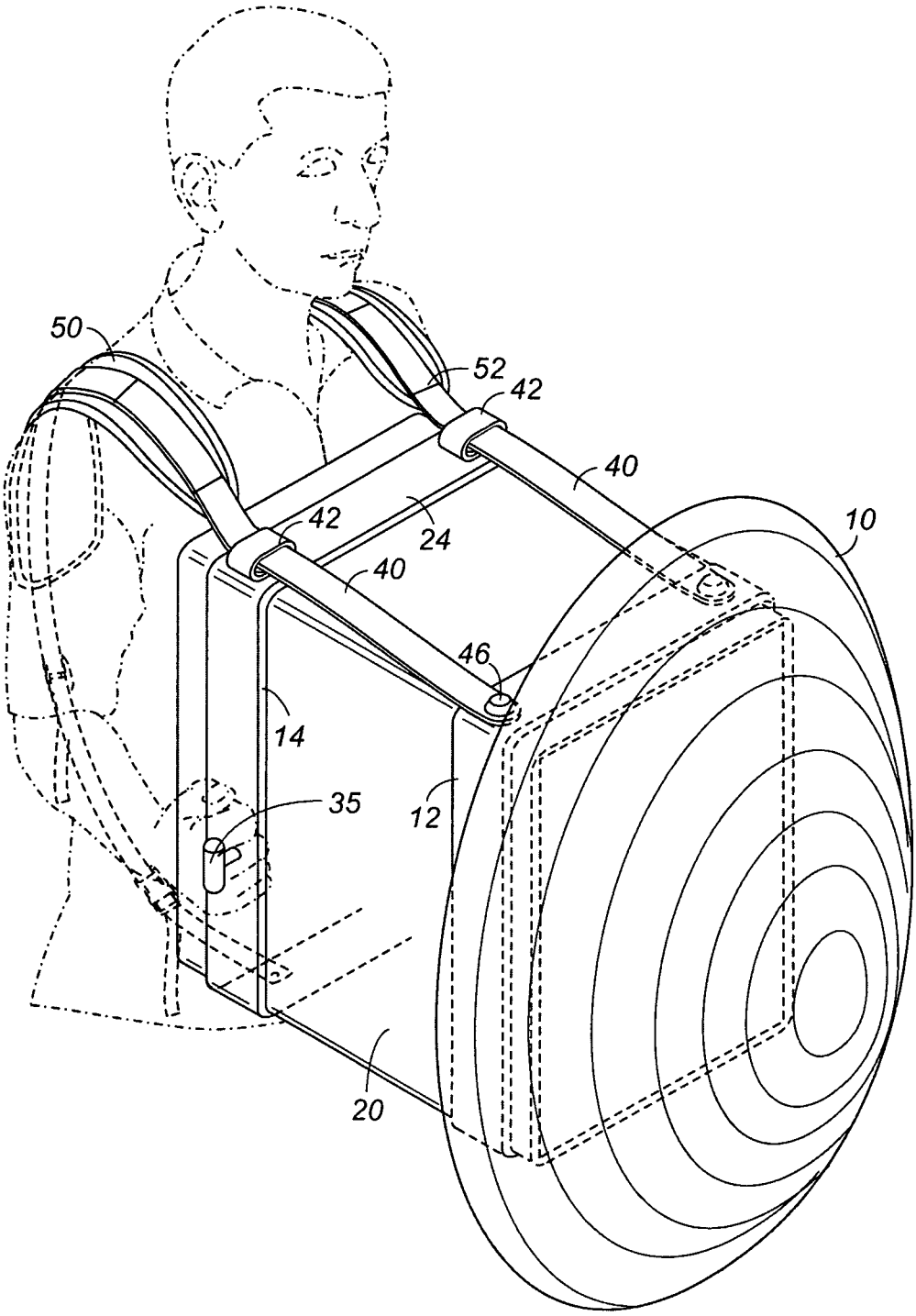
FIG. 1 is a pictorial view of my training shield being worn by a Holder.

With reference to the drawing, a "shield Holder" H (FIG. 1) is wearing the training shield S of this invention. The shield S includes a hemispherical front striking member 10 mounted on a rear cubical interspacer 20 to establish a safe non-contact distance between Holder and Fighter so the Fighter can use striking techniques at full force, but without contacting the Holder. The interspacer is hung on (worn by) the shield Holder H by straps, including shoulder straps 52 with pads 50, and back strap works 60 with strap members 64, 66, adjusters 62, and fastener clips.

Figure 3:
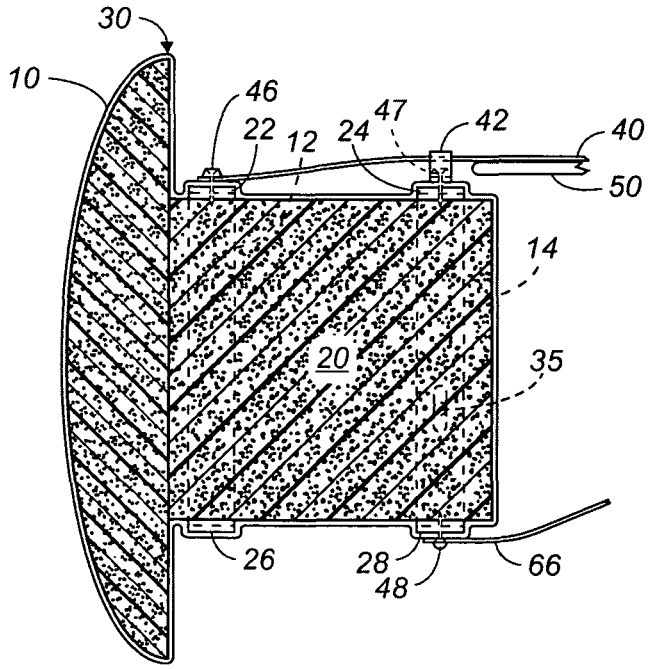
FIG. 3 is a sectional view of the plane 3-3 indicated in FIG. 2.
Figure 4:
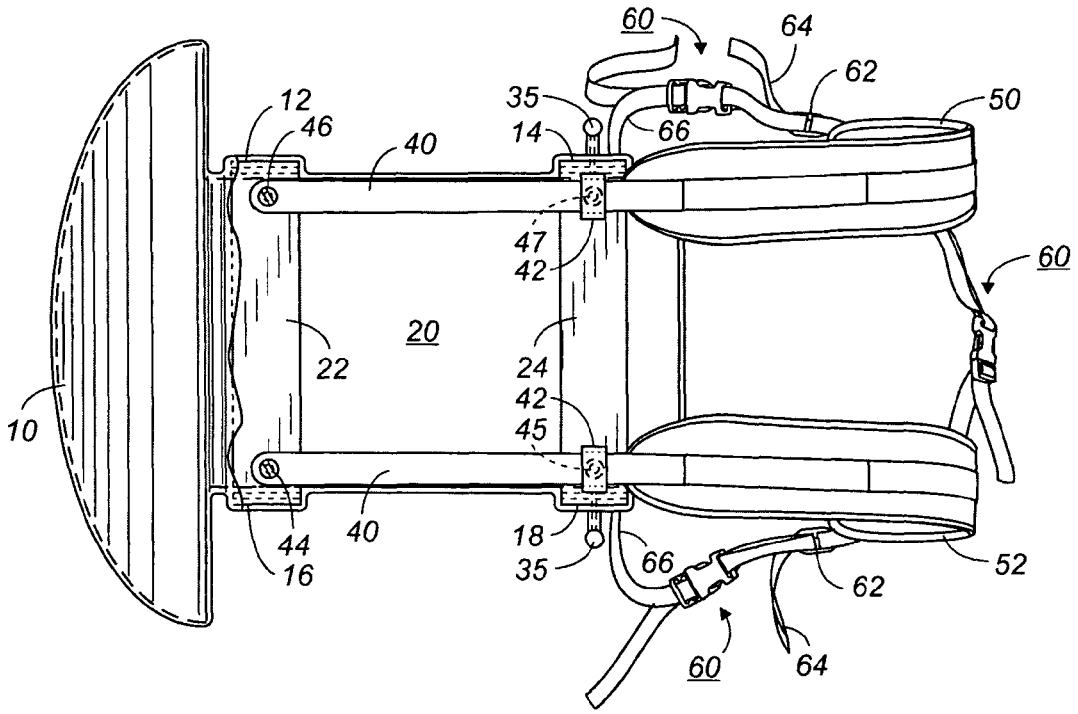
FIG. 4 is a top view of the training shield of FIG. 1.
Figure 5:
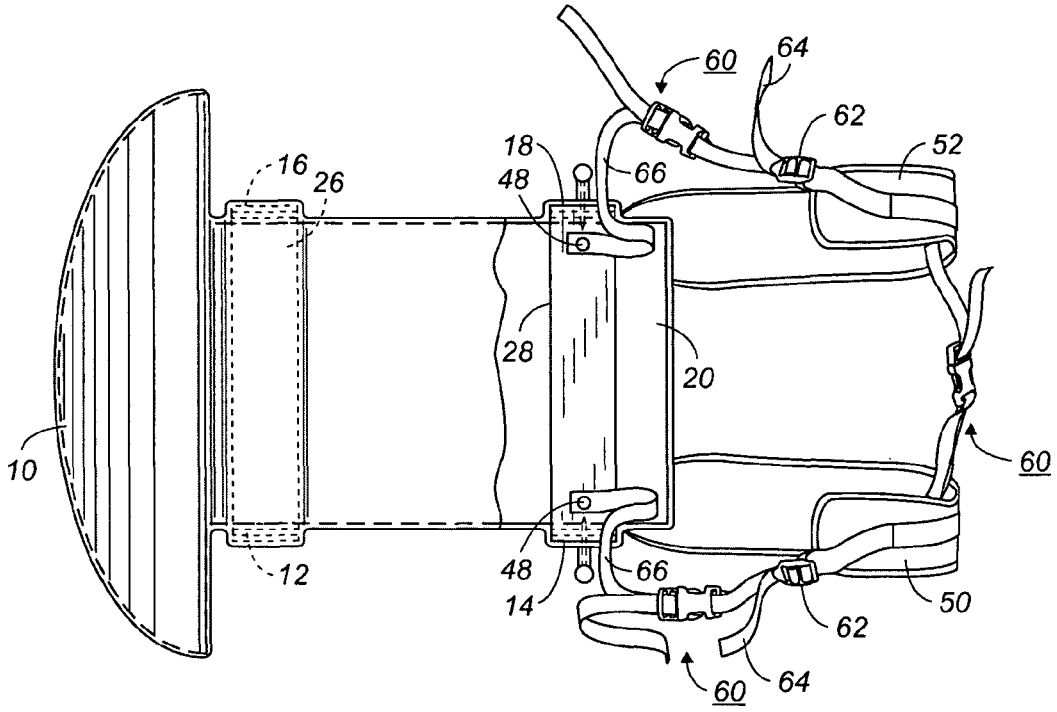
FIG. 5 is a bottom view of the training shield of FIG. 1.

The hemispherical front striking member 10 includes a pad of high density foam material, the pad being enclosed in a vinyl protective cover 30 (FIG. 3).

Figure 2:
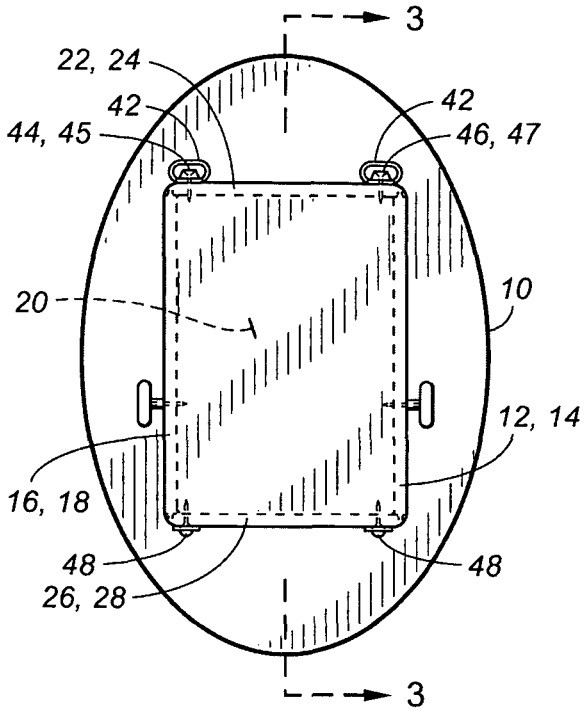
FIG. 2 is a rear view, as from the Holder's midriff, of the training shield of FIG. 1.

The interspacer 20 is of lightweight, low density foam material, framed for rigidity by plywood frame members 12, 14, 16, 18, 22, 24, 26, 28 (hereinafter "frameworks"). See also FIG. 2. The assemblage of interspacer 20 and its frameworks is connected to the back strap works 60 by suitable front straps works 40, connector loops 42, and connectors 44, 45, 46, 47, 48.

The shield S also includes left and right handles 35 on the rear of the interspacer 20 (FIG. 1). The shield Holder H controls the position or attitude of the training shield relative to his own torso, and relative to the Fighter by means of the handles 35.

With a shield Holder H wearing and operating my full contact training shield, a Fighter can perform all boxing and martial arts techniques except leg kicks. The shield Holder, in his role as Holder, is also in training, dodging and averting the Fighter.

With my shield, unlike shields of the prior art, the following techniques can be performed without pause by the Fighter:

All kicks (front, side, back, spinning, roundhouse, axe, jump)

All punches (straight, hook, uppercut) and hand strikes (hammer, elbow, knife)

Knee action: (front knee, side knee, flying knee)

The shield Holder, with the shield securely strapped on and with hands on the shield handles, also performs a variety of functions:

stand still
move backward and forward
move side to side
circle the Fighter
charge the Fighter
avoid or dodge the Fighter
braces for impact by taking a forward leaning stance In this specification, the terms "hemispherical" and "cubical" are convenient short terms for "generally hemispherical" and "generally cubical" respectively. Likewise "martial arts" is short for "martial arts and boxing". Any terms indicative of orientation (e.g. front, back; left, right; upper, lower; top, bottom; horizontal, vertical) are intended only to correspond with the invention as illustrated for ease of understanding the claimed invention. Such terms are not to be intended as claim limitations. The foregoing description of a preferred embodiment is illustrative. The concept and scope of the invention are not limited by such details but only by the following claims.

What is claimed is:

1. A martial arts training shield for wear by a shield holder as a target for impact by a fighter, said shield comprising:

a front striking member, a rear interspacer, and strap works adapted for mounting said rear interspacer to said shield holder;

said front striking member including a first width and a forward-convex hemispherical pad of foam material in a protective cover;

said rear interspacer including a top surface having a front end and a rear end, a bottom surface, two connectors, each connector disposed toward said front end of said top surface, two connector loops, each connector loop disposed toward said rear end of said top surface, a second width that is less than said first width and a framework extending rearward from said front striking member to establish a non-contact distance between said fighter and said holder, and said strap works including two straps, each strap has a first end configured for attachment at one of said two front end connectors, respectively, and a portion of each strap is slidingly engaged through one of said two connector loops, and a second end of each strap is attached to said bottom surface, said strap works are configured for removable mounting of said rear interspacer and said front striking member on said holder;

said rear interspacer further including left and right rear control handles for control of position and attitude of said training shield by said holder relative to said holder and relative to said fighter; whereby, when said shield is placed upon said holder, said fighter can perform kicks, punches, hand strikes and knee action on said front striking member without contacting said holder, and said holder with hands on said handles can maneuver self and said shield relative to said fighter.

2. A martial arts training shield for wear by a shield holder as a target for impact by a fighter, said shield comprising:

a hemispherical front striking member mounted on a rear interspacer, said hemispherical front striking member and said rear interspacer adapted for wear on a shield holder by removable and adjustable strap works;

said hemispherical front striking member including a first width and a pad of foam material with a first density in a protective cover;

said rear interspacer including a top surface having a front end and a rear end, a bottom surface, two connectors, each connector disposed toward said front end of said top surface, two connector loops, each connector loop disposed toward said rear end of said top surface, a second width that is less than said first width and a body of a foam material with a second density that is lower than the first density within a supporting framework;

said rear interspacer further including left and right rear control handles for control of position and attitude of said training shield by said holder relative to said holder's torso and relative to said fighter;

said removable and adjustable strap works including two straps, each strap has a first end configured for attachment at one of said two front end connectors, respectively, and a portion of each strap is slidingly engaged through one of said two connector loops, and a second end of each strap is attached to said bottom surface, said strap works are configured for removable and adjustable mounting of said rear interspacer and said front striking member on said holder;

whereby, when said shield is placed upon said holder, said fighter can perform all of the following boxing and martial arts techniques without pause as said holder is dodging and averting said fighter when said fighter performs: kicks, including front, side, back, spinning, roundhouse, axe, and jump kicks; punch, including straight, hook, and uppercut punches; hand strikes, including hammer, elbow, and "knife" strikes; and knee action, including front, side, and flying knee action; while said holder, with said shield in place, and with hands on said handles, can: stand still; move backward and forward; move side to side; circle the fighter; charge the fighter; avoid or dodge the fighter; and brace for impact by taking a forward leaning stance.

* * * * *